United States Patent [19]

Hellberg

[11] 4,272,032

[45] Jun. 9, 1981

[54] DISINTEGRATOR OF WOODEN PRODUCTS

[76] Inventor: Bengt Hellberg, Kvartsekelsgatan 3A, S-415 09 Göteborg, Sweden

[21] Appl. No.: 33,185

[22] Filed: Apr. 25, 1979

[51] Int. Cl.[3] ..... B02C 1/04; B02C 1/10

[52] U.S. Cl. ..... 241/263; 241/264

[58] Field of Search ..... 241/263, 264, 283

[56] References Cited

U.S. PATENT DOCUMENTS

| | | | |
|---|---|---|---|
| 170,560 | 11/1875 | Heston | 241/283 X |
| 2,002,224 | 5/1935 | Eastwood | 241/263 |

FOREIGN PATENT DOCUMENTS

| | | | |
|---|---|---|---|
| 419373 | 8/1974 | U.S.S.R. | 241/264 |
| 466911 | 7/1975 | U.S.S.R. | 241/264 |
| 559955 | 5/1977 | U.S.S.R. | 241/283 |

*Primary Examiner*—Howard N. Goldberg

[57] ABSTRACT

Disintegrator of wood products, such as demolition timber containing objects of metal and other hard material comprising a housing having an opening in its top for receiving the wood products for treatment and two groups of vertically extending cutting devices in the interior thereof. One group of the cutting devices is fixedly located near one end of the housing and the other group of cutting devices is mounted on a movable frame. Each group of the cutting devices are in side-by-side and in spaced relationship with each other, with the interspace between the cutting devices of one group being bridged by the corresponding cutting devices of the other group. A power jack is connected with the frame to move the groups of cutting devices into overlapping relationship to cut and disintegrate the wood products in the housing. Openings in the frame and housing are provided for feeding-out disintegrated material.

6 Claims, 9 Drawing Figures

DISINTEGRATOR OF WOODEN PRODUCTS

The present invention relates to a disintegrator of wooden products, for example demolition timber containing objects of metal and other hard material.

Wooden products, scaffoldings, wooden boxes etc. from, for example demolition of buildings and which have hitherto been transported to the refuse dump, may in the future be utilized by paper factories for the manufacture of wood pulp. In order to serve this purpose the wood products in question first must be chopped, after which pieces with nails must have them and other objects of iron removed.

It is a principal object of the invention to provide a disintegrator of the kind mentioned, which can be utilized for the disintegration of, for example heavy logs with adhering iron objects. Such wood can comprise demolition timber containing nails, flat bars, angle iron, girders etc. For this purpose it is not possible to use wood choppers of the prior art having a rotating cutting die head, as such cutting die heads will very quickly be destroyed by the hard objects adhering to the timber.

Said object is achieved by a disintegrator according to the present invention, which is substantially characterized by comprising a housing, provided at its top with an opening in order to receive the wood products intended to be treated, two groups of vertically extending cutting means placed side by side with a certain distance in between them in the interior of the housing near to said opening, at least one group of the cutting means being displaceable towards and overlapping the other group of cutting means, the interspace between the cutting means of one group being bridged by the corresponding cutting means of the other group in such a manner that cutting edges of the cutting means of both groups sliding against each other in between them cooperate in order to form a cutting device, and the housing being provided in its lower part with means for feeding-out of the disintegrated material.

Figure 1:
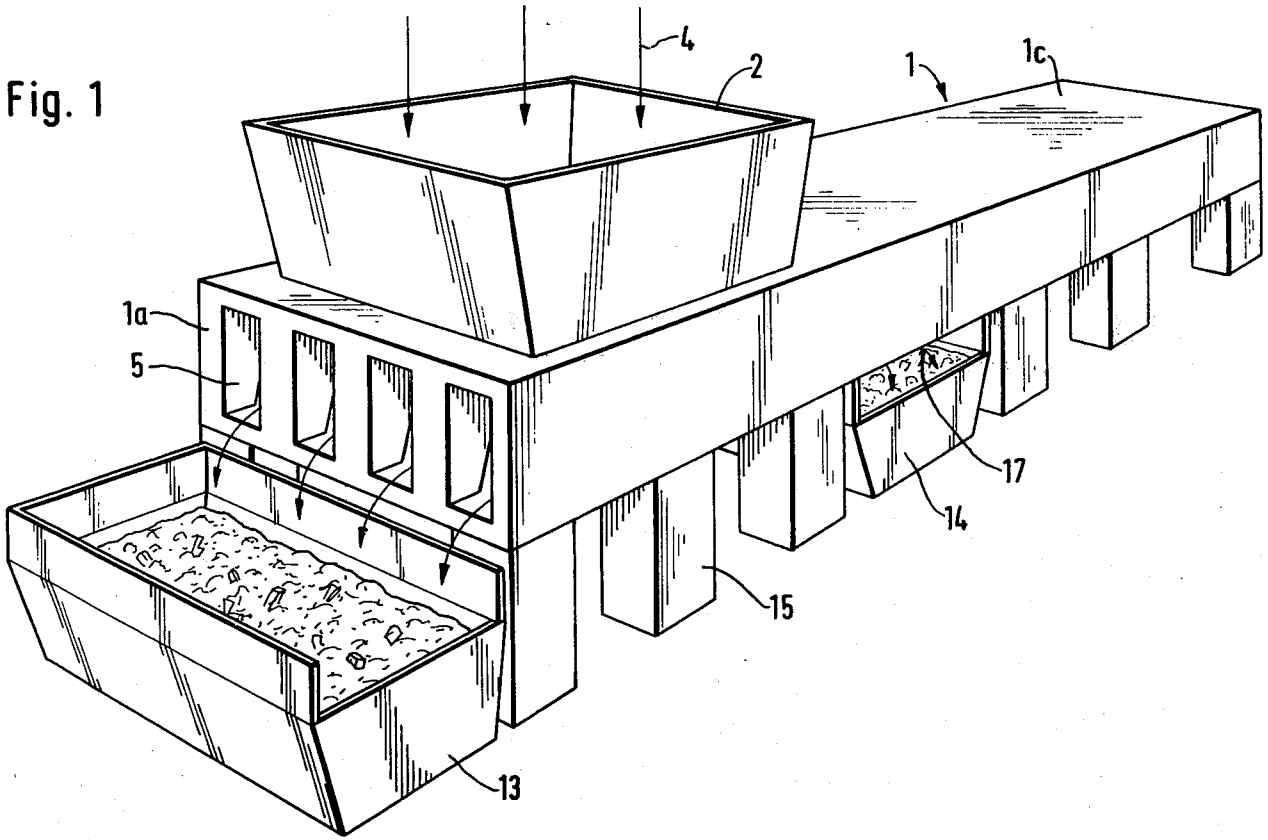
Figure 2:
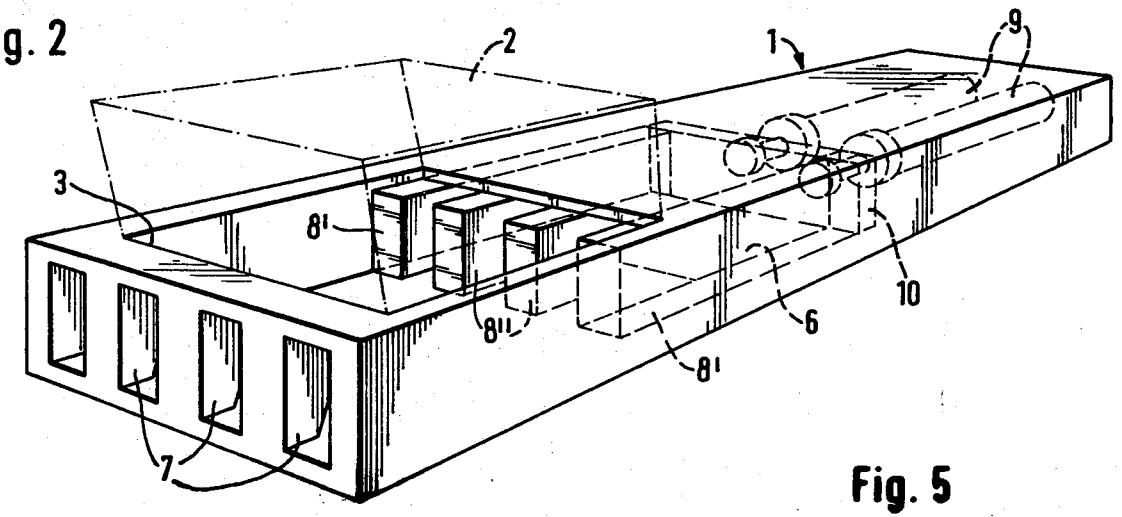
Figure 5:
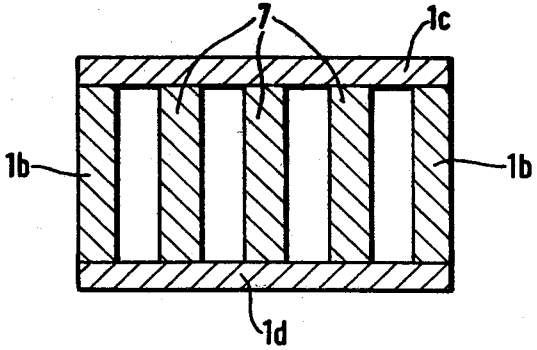
Figure 3:
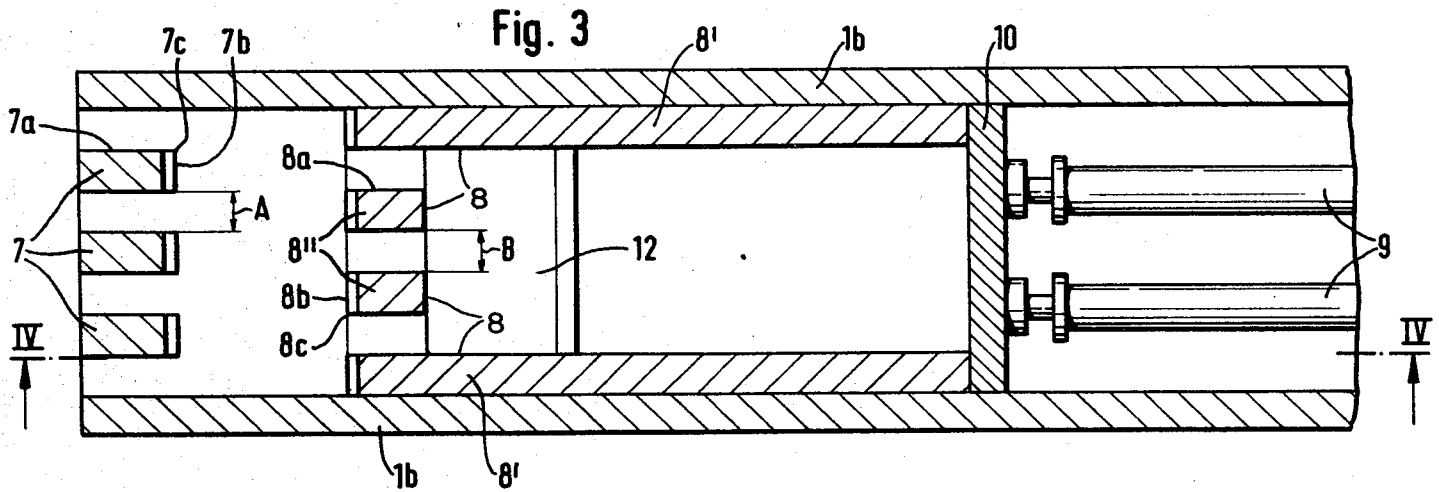
Figure 4:
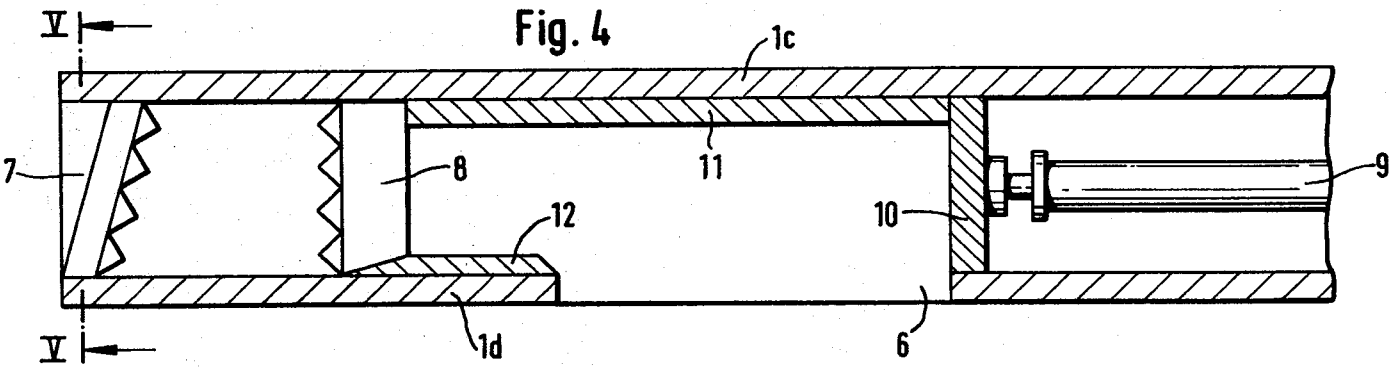
Figure 6:
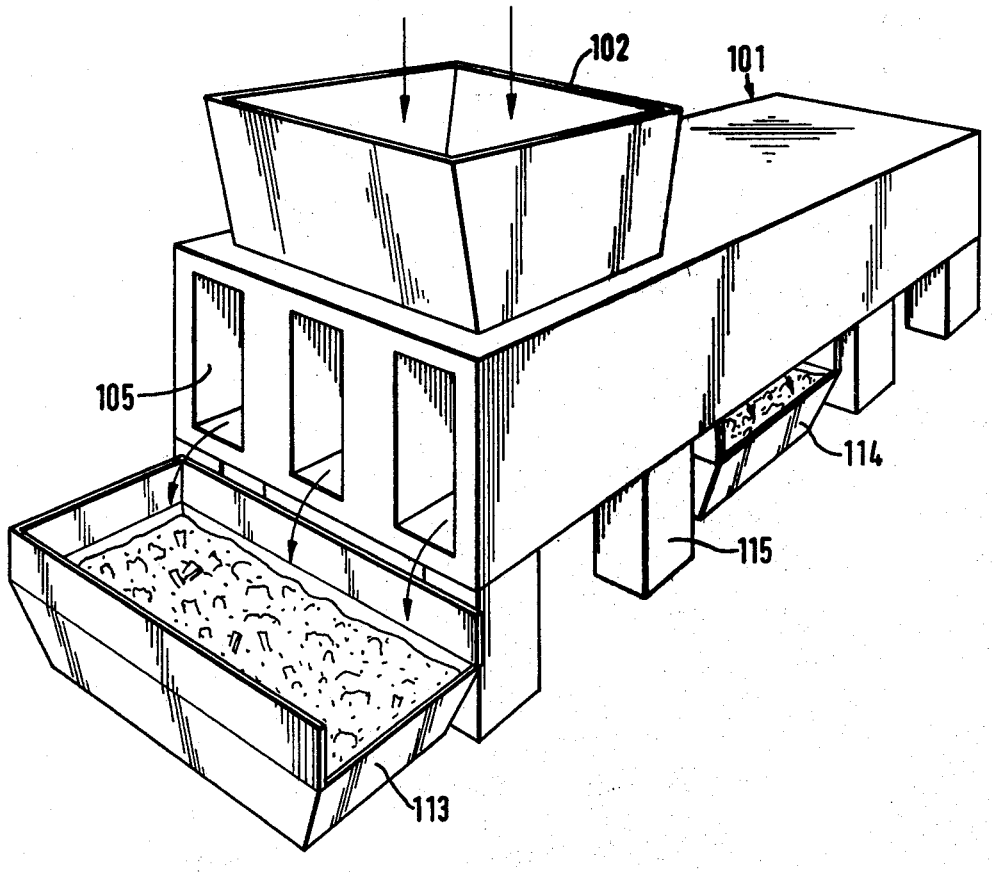
Figure 7:
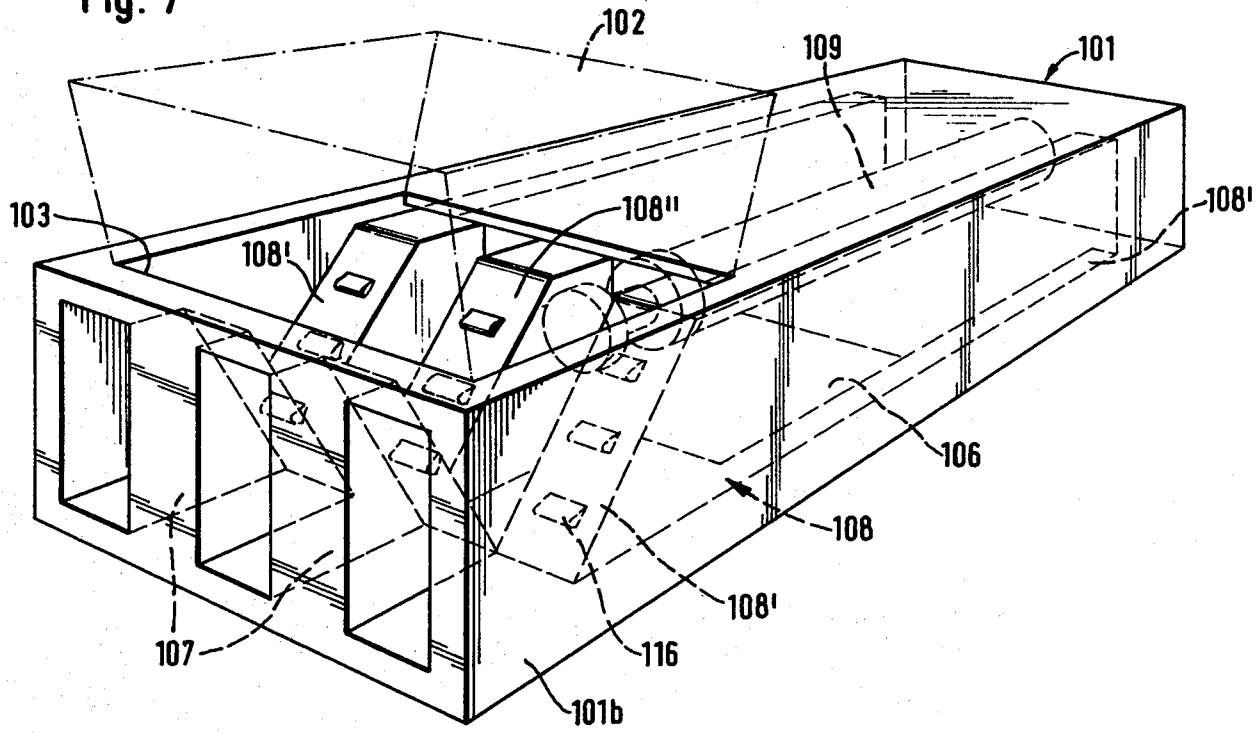

A few embodiments of the invention are described in the following detailed description, reference being made to the accompanying drawings, in which FIG. 1 is a perspective view of a disintegrator made according to the invention as seen from above, FIG. 2 is a schematic translucent view of the disintegrator shown in FIG. 1, FIG. 3 is a view of a longitudinal horizontal cross-section through the disintegrator illustrated in FIGS. 1 and 2, FIG. 4 is a view of a longitudinal vertical cross-section along the line IV—IV in FIG. 3, FIG. 5 is a view of a transverse vertical cross-section through said disintegrator along the line V—V in FIG. 4, FIG. 6 is a perspective view corresponding to the one in FIG. 1 and showing a disintegrator according to a second example of embodiment of the invention, and FIG. 7 is a translucent view of the device according to FIG. 6 corresponding to FIG. 2.

The disintegrator called the "timber chopper" illustrated in FIG. 1 comprises a horizontal housing 1 of long extension, in the interior of which the disintegrator tools are housed. In the upper portion of the housing near to one of its ends a charging opening 3 surrounded by a rim 2 is provided, through which opening timber intended for disintegration can be fed in the direction of the arrows 4. In one of its end walls 1*a* the housing has a number of discharge openings 5 for the disintegrated timber material. On the other side of the charge opening 3 in the lower portion of the housing a second discharge opening 6 for the discharge of disintegrated timber material is provided at the arrows 17 in FIG. 1. The discharge opening 6 is indicated with broken lines in FIG. 2. This opening is also clearly visible in FIG. 4. The discharge openings 5 provided in the end wall of the housing are separated from each other by means of a first group of cutting means 7, the lateral walls 7*a* of which are substantially smooth, the cutting means having a cutting front 7*b* facing the interior of the housing in the illustrated embodiment having a step design, the steps of which extend right on to the lateral walls 7*a* of the cutting means resulting in the formation of cutting edges 7*c* of saw-tooth design. It is of course within the scope of the invention to design the cutting means with smooth front surfaces, resulting in straight cutting edges. A second group of cutting means 8 likewise has smooth lateral surfaces 8*a* and front sides 8*b* of step design. The cutting means 8 are displaceable in the longitudinal direction of the housing 1 by means of two hydraulic cylinders 9. As is best evident from FIG. 3, the cutting means 8 are sidewise displaced relative to the cutting means 7 and have a width, which substantially corresponds to the distance A between the cutting means 7, when they are displaced in the forward direction overlapping the cutting means 7, whereas consequently the cutting means 7 in their turn bridge the distance B between the cutting means 8. In the illustrated embodiment the fixed cutting means 7 are three in number, whereas the movable cutting means 8 cooperating with them are four in number. This number can of course be varied depending upon the degree of disintegration desired. The outer ones 8', of the movable cutting means are formed by vertical plates each extending along its longitudinal lateral wall 1*b* of the housing 1, which plates together with a likewise vertically extending plate 10, a horizontal plate 11 extending along the underside of the top wall 1*c*, and a plate 12 extending along a portion of the bottom wall 1*d* of the housing form a frame, to the rear end of which one end of the power cylinders 9 is attached. The rear ends of the power cylinders are fastened to the housing. At the front end of the frame the central cutters 8" extending between the two horizontal plates 11 and 12 are supported. In the FIGS. 2–4 the movable cutter group 8 is located in its rear position of displacement, in which timber fed through the charge opening 3 is permitted to fall down in the interspace between the two groups of cutting means. As is best evident from FIG. 4 the front sides of the cutting means are such that they diverge in downwards direction by an oblique setting of the front surfaces of the cutting means 7. It is of course possible also to give the front surfaces of the cutting means 8 an oblique setting in a corresponding manner. Due to the toothing of the front surfaces the timber is impeded when treated from again be pushed up through the input opening. This effect is further strengthened by the diverging position of the cutting surfaces. When by means of the power cylinders 9 the movable cutting means 8 are displaced to the left according to the drawings, the timber is disintegrated by the cutting edges 7*c* and 8*c* of the two cutter groups sliding against each other. Due to the oblique setting of the cutting edges in between them, a cutting is obtained, i.e. a successive cutting of the interspaced material is obtained, which brings a more uniform distribution of the required force in its train than what would have been the case with in between them parallel cutting edges of the two groups. When the cutting means 7 and 8 move overlapping each other, the cutting means 8 with its front sides will expel disintegrated material through the discharge openings 5, whereas the cutting means 7 with their front sides expel the disintegrated material to the rear side of the cutting means 8, this material then falling down through the discharge opening 6. Disintegrated material can suitably be collected in a bin as the bins such 13 and 14 respectively illustrated in FIG. 1. As is evident from FIG. 1, the housing 1 is supported by a foundation 15 at such a height above the ground that there is room for the bins 13 and 14 below their respective discharge openings. The disintegrator illustrated in FIGS. 6 and 7 like the one just described above comprises a horizontal housing 101 supported by a foundation 115. In this embodiment bins 113 and 114 are provided for collecting the disintegrated material discharged from dishcharge openings 105 and 106, respectively. The charge opening for timber intended for treatment is here indicated with 103, and the rims surrounding the charge opening is indicated with 102. The fixed cutters, which in this embodiment only are two in number, are indicated with 107 and the movable cutters are indicated with 108. The cutting means 108 are consequently three in number and comprise two disk-shaped cutting means 108' extending along the longitudinal lateral walls **101*b* of the housing, and a smaller cutting means 108'', which is supported by the frame, not shown, of which the outer cutters 108' form part in a manner corresponding to the one, which has been described in connection with the previous embodiment. In this embodiment the front sides belonging to the two groups diverge in upwards direction. In the illustrated embodiment these front sides are moreover substantially smooth for the formation of straight cutting edges. However, said front sides have a number of projecting barb-like noses 116 serving the purpose to impede timber, which has been fed in, from being pushed up through the charge opening 103. It is of course within the scope of the fundamental idea of the invention to design the front sides of the cutting means with a step-like shape similar to the shape of the cutting means of the previous example. The cutting means 108 are driven by a power cylinder 109, which extends between said cutting means and the rear end wall of the housing 101. The lower opening for discharge of materials is indicated with broken lines and carries the number 106**. The function of the disintegrator is in principle the same as in the previously described device, and therefore does not require any detailed description.

The invention is not limited to the embodiments described above and illustrated in the drawings by way of example only, but can be varied as to its details within the scope of the following claims.

I claim:

1. Disintegrator of wood products, for example demolition timber containing objects of metal and other hard material, comprising a housing provided with an opening in its top for receiving the wood products intended for treatment, two groups of vertically extending cutting means in the interior of said housing, a movable supporting frame formed in said housing, one group of said cutting means being fixed and located near to one end of said housing and the other group of said cutting means being mounted on said frame, each group of cutting means being in side-by-side and in spaced relationship with each other, the interspace between the cutting means of one group being bridged by the corresponding cutting means of the other group, a power jack connected with said movable supporting frame operable to move said other group of cutting means into overlapping relationship with said one group of cutting means in such manner that cutting edges of the cutting means of both groups slide against each other and cut and disintegrate the wood products in said housing, and an opening in the underside of said housing for feeding-out of the disintegrated material, said frame having a discharge opening in its lower rear portion behind said other group of cutting means which at least in one position of displacement of said frame communicates with said opening in the underside of said housing.

2. Disintegrator according to claim 1, wherein said discharge opening is located at the side of said other group of cutting means which faces away from said opening in the top of the housing.

3. Disintegrator according to claim 1 or 2, wherein said two groups of cutting means face each other with their front sides diverging in an upwardly direction.

4. Disintegrator according to claim 1 or 2, wherein said two groups of cutting means are provided with gripping teeth on their front sides.

5. Disintegrator according to claim 4, wherein the gripping teeth extend across the whole width of the front sides of the cutting means resulting in the formation of sawtooth-shaped cutting edges at the lateral front edges.

6. Disintegrator according to claim 1 or 2, wherein said two groups of cutting means face each other with their front sides diverging in a downwardly direction.

* * * * *